United States Patent [19]

Sims

[11] Patent Number: 4,854,577

[45] Date of Patent: Aug. 8, 1989

[54] EXERCISE MEANS

[75] Inventor: Anthony M. Sims, Murray Bridge, Australia

[73] Assignee: Titan Fitness Products Pty., Ltd., Blair Athol, Australia

[21] Appl. No.: 163,949

[22] Filed: Mar. 3, 1988

[30] Foreign Application Priority Data

Mar. 3, 1987 [AU] Australia ..... PI0643

[51] Int. Cl.[4] ..... F16F 5/00

[52] U.S. Cl. ..... 272/130

[58] Field of Search ..... 272/130, 129, 73, 132; 188/297, 284, 279, 313, 314; 137/516.25, 512.1

[56] References Cited

U.S. PATENT DOCUMENTS

| | | | |
|---|---|---|---|
| 2,604,953 | 7/1952 | Campbell | 188/314 X |
| 3,465,851 | 9/1969 | Callegari et al. | 188/313 X |
| 3,506,312 | 4/1970 | Siddall | 137/512.1 |
| 3,827,537 | 8/1974 | Haller, Jr. et al. | 188/313 X |
| 4,226,415 | 10/1980 | Wright | 272/130 |
| 4,289,309 | 9/1981 | Hoffman | 272/132 X |
| 4,750,735 | 6/1988 | Furgerson et al. | 272/130 X |

*Primary Examiner*—Richard J. Apley
*Assistant Examiner*—Howard Flaxman
*Attorney, Agent, or Firm*—Henry Sternberg; Bert J. Lewen

[57] ABSTRACT

An hydraulic device is used for an exercise machine, having a double-acting hydraulic pump, which can be moved in one direction for developing one set of muscles (for example, biceps), and in the other direction for developing another set of muscles (for example, triceps). The invention provides a valve having two portions, each with a pressure regulating valve and a non-return valve. Oil displaced by operation of the pump in a first direction passes through a first pressure regulating valve, and return oil through a second non-return valve, and this is reversed when the pump is operated in a second direction. If the pressure regulating valves permit flow rates which differ, they can be made appropriate for movement effected by the different sets of muscles.

8 Claims, 1 Drawing Sheet

EXERCISE MEANS

This invention relates to an hydraulic device which is useful for an exercise machine for a person who requires exercise, for example for strengthening of various sets of muscles for sporting purposes or for rehabilitation purposes.

BACKGROUND OF THE INVENTION

Different users require to exercise against different resistances, and the same user may require to exercise different sets of muscles at the same time, for example biceps and triceps. However triceps are only about 60% of the strength of biceps, and consequently an exercise machine having the facility to exercise both triceps and biceps desirably will offer resistance to movement of a user's arm in different degrees for forward and reverse movement for developing the respective sets of muscles. It is therefore the object of this invention to provide such a machine which will be simple, and which will be capable of easy adjustment.

BRIEF SUMMARY OF THE INVENTION

In an embodiment of this invention an hydraulic device used for an exercise machine has a double-acting hydraulic pump which can be moved in one direction for developing one set of muscles (for example biceps), and in the other direction for developing another set of muscles (for example triceps).

The invention provides a valve having two portions, each with a pressure regulating valve and a non-return valve. Oil displaced by the operation of the pump in the first direction passes through a first pressure regulating valve and return oil through a second non-return valve, and this is reversed when the pump is operated in the second direction. If the flow regulating valves permit pressure rates which differ, they can be appropriate for movement effected by different sets of muscles. Adjustment means can be provided so that the resistance to flow from the hydraulic pump can be varied to suit different sets of muscles. More specifically, an hydraulic device according to this invention is useful for an exercise machine, and comprises a double-acting hydraulic pump having two hydraulic outlets, a valve, and conduits interconnecting the pump and valve, the valve comprising two portions, the first conduit connecting a first pump outlet to a first valve portion and a second conduit connecting a second pump outlet to a second valve portion, each valve portion comprising a pressure regulating valve and a non-return valve, so arranged that flow of pressure fluid from the pump through each conduit is through a respective pressure regulating valve, and consequential return flow to the pump through the other conduit is through a respective non-return valve.

BRIEF SUMMARY OF THE DRAWINGS

An embodiment is described hereunder in some detail with reference to and is illustrated in the accompanying drawings in which.

Figure 4:
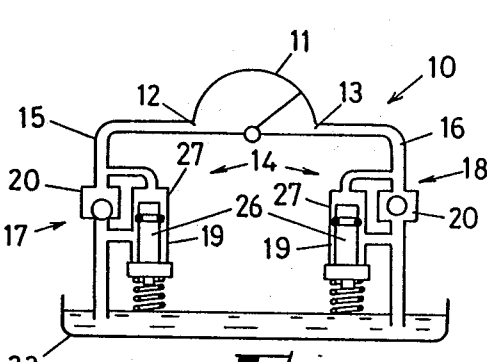
FIG. 4 is a diagrammatic representation of the invention.

In this invention, as shown in FIG. 4 an hydraulic device 10 which is useful as an exercise machine comprises a semi-rotary double-acting hydraulic pump 11 having two hydraulic outlets 12 and 13, a valve 14, and first and second conduits 15 and 16 connecting respective portions 17 and 18 to the pump 11.

Each portion 17 and 18 comprises a pressure regulating valve 19 and a non-return valve 20.

Figure 3:
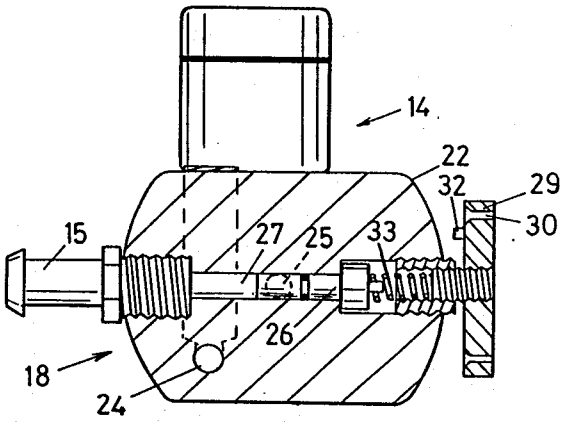
FIG. 3 is a cross-section taken on line 3—3 of FIG. 2.
Figure 1:
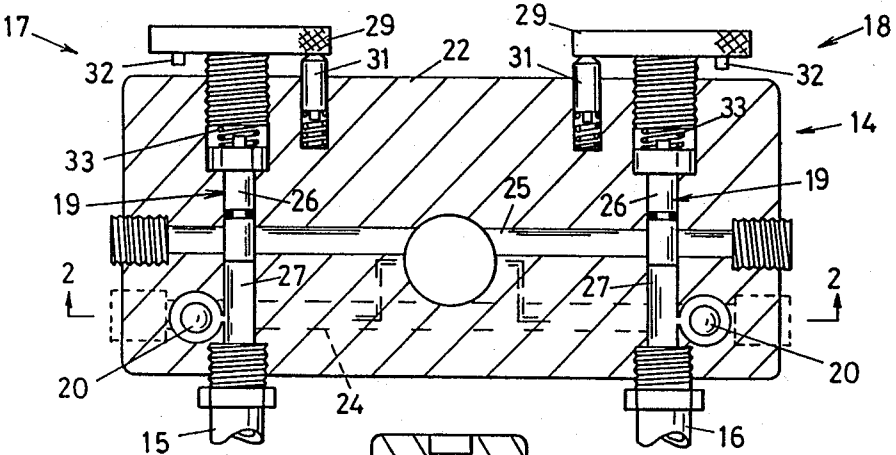
FIG. 1 is a plan section.
Figure 2:
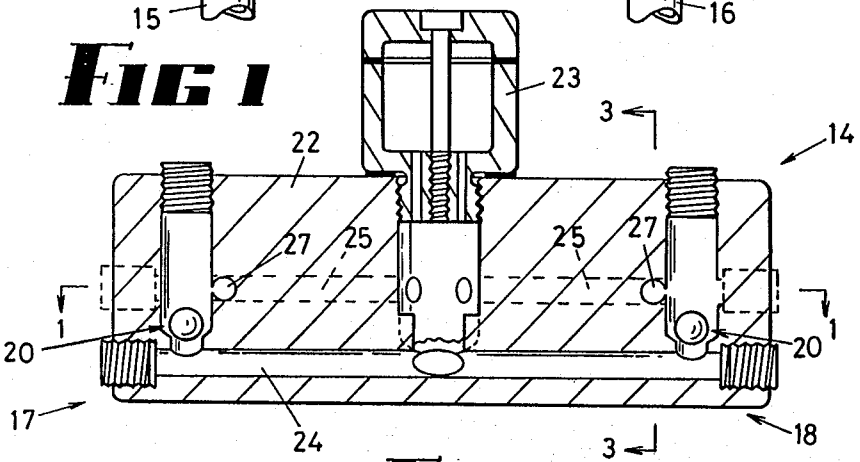
FIG. 2 is an elevational taken on line 2—2 of FIG. 1, and showing on line 1—1 the plane on which the section of FIG. 1 is taken.

Reference is now made to FIGS. 1, 2 and 3 which describe the valve 14 in more detail.

The valve 14 comprises a body 22 to which is secured a small reservoir 23 upstanding from its upper surface.

The reservoir 23 connects the two non-return valves 20 through a lower passage 24 as best seen in FIG. 2, in each case the connection being to the suction side of the non-return valve 20. An upper passage 25 also connects to the reservoir 23, and joins the first and second conduits 15 and 16 thereto, but in each case through a pressure regulating valve 19. Each pressure regulating valve 19 comprises a plunger 26 which extends in a respective conduit extension passage 27 which crosses the upper passage 25. Each conduit extension passage 27 also connects to the pressure side of a respective non-return valve 20, the suction side of which opens to lower passage 24.

There are provided two adjustment knobs 29 each containing a plurality of apertures 30 on a pitch circle, and the apertures 30 sequentially receive a spring-loaded plunger 31 upon rotation of the adjustment knobs 29. Each adjustment knob 29 is also provided with a stop pin 32 which inhibits rotation beyond one full revolution.

The adjustment knobs 29 threadably engage the body 22 and bear against respective plungers 26 of pressure regulating valves 20 through springs 33, applying spring pressure to respective pressure regulating valve plungers which are slidable within their respective conduit extension passages 27.

Upon high pressure being applied to the first conduit 15 for example, the first pressure regulating valve plunger 26 is urged along its conduit extension passage 27 until it exposes the passage 25 for fluid flow. The orifice size at the interconnection of passages 25 and 27 is relatively small, and therefore the pressure regulating valves 19 remain at a substantially constant position so that the valves function as non-return valves as well as pressure regulating valves.

While high pressure is applied to the conduit 15, that high pressure fluid enters the contiguous non-return valve space 20 above the ball and retains that ball on its seat, and pressure is maintained within the passage 27 until oil flows past the pressure regulating valve 19 into the passage 25 when the pressure is lost as the oil reenters the reservoir space. There is therefore no pressure applied to the non-return valve 20 on the other side (the right hand side) of the body 22 and therefore that valve can lift to allow flow of oil from reservoir 23, through the other passage 27 and into the conduit 16. The reverse will happen if pressure is applied to conduit 16 and conduit 15 then becomes a suction line.

Since the adjustment knobs 29 can be individually adjusted, the pressures in the conduits 15 and 16 can be individually adjusted to correspond with flow rates which will offer resistance to a user of the hydraulic machine, such that different forces are required to move the vane of the hydraulic pump 11 in opposite directions. This is valuable in a wide range of exercises, not merely in the strengthening of the biceps and triceps of the arm.

The above description relates to a valve wherein the return oil flow takes place within a passage within the valve body, but quite clearly the valve can be used to control actuation of a ram if that is required, the necessary changes being made to the configuration of the passages.

The claims defining the invention are as follows:

1. A hydraulic device for an exercise machine, comprising a double-acting hydraulic pump having two hydraulic outlets, a valve having a valve body, and two conduits respectively interconnecting said pump outlets and valve body, the valve body containing two conduit extension passages therein in fluid flow communication respectively with said conduits, an upper passage which crosses said extension passages to provide interconnection with each extension passage, a lower passage, a pair of non-return valves opening to the lower passage and having their pressure sides in fluid flow communication respectively with said extension passages, a pair of pressure regulating valves comprising valve members in the respective conduit extension passages which normally close the interconnections between those passages and the upper passage but which are independently movable upon application of pressure to open said interconnections, spring means bearing against said valve members urging them toward their normally closed positions, and a reservoir space within the valve body which opens into both said upper and lower passages intermediate their ends, so arranged that flow of pressure fluid from the pump through each said conduit is through a respective said pressure regulating valve, and consequential return flow to the pump through the other said conduit is through a respective said non-return valve.

2. Device of claim 1 further comprising a reservoir carried by the body and in fluid flow communication with said reservoir space.

3. Device of claim 2 wherein each said non-return valve is a ball valve which is in fluid flow communication with the reservoir.

4. Device of claim 1 wherein each pressure regulating valve comprises a plunger slidable in a passage in said body.

5. Device of claim 4 further comprising a pair of adjustment knobs threadably engaging the body, said spring means comprising a pair of springs and each knob having a said spring between its inner end which abuts a said plunger and urges it to close the fluid flow communication between the passage in which it is slidable and said upper connecting passage, but arranged to open said fluid flow communication therebetween upon sufficient pressure being applied to the plunger to compress the spring and move the plunger in an outward direction.

6. Device of claim 4 further comprising a pair of adjustment knobs threadably engaging seating apertures in said body, each adjustment knob having a spring between its inner end and a said plunger, each adjustment knob having a plurality of plunger engaging apertures spaced around it circumferentially, and further comprising spring-loaded plungers stationarily located in said body which releasably engage said plunger engaging apertures upon rotation of said adjustment knobs.

7. Device of claim 1 wherein said hydraulic pump is a manually operatable semi-rotary pump.

8. Device of claim 1 wherein the valve including the valve body comprises a unit separate from the pump and operatively interconnected therewith by said two conduits.

* * * * *